US005785199A

United States Patent [19]

Woidtke

[11] Patent Number: 5,785,199

[45] Date of Patent: Jul. 28, 1998

[54] BEVERAGE CAN OPENING PROTECTOR

[76] Inventor: Richard Clayton Woidtke, 1718 Pinion Dr., Roseville, Calif. 95747

[21] Appl. No.: 759,175

[22] Filed: Dec. 4, 1996

[51] Int. Cl.[6] ..... B05D 51/20

[52] U.S. Cl. ..... 220/258; 220/269; 220/906; 220/730

[58] Field of Search ..... 220/906, 730, 220/729, 269, 278, 284–286, 254, 256–258, 243–251, 271, 314; 81/3.55, 3.47, 3.57, 3.09

[56] References Cited

U.S. PATENT DOCUMENTS

| | | | |
|---|---|---|---|
| D. 329,604 | 9/1992 | Kuczer . | |
| 3,637,104 | 1/1972 | Dutnell | 220/251 X |
| 3,680,732 | 8/1972 | Dickie | 220/314 |
| 4,120,216 | 10/1978 | Goldberg | 81/3.57 |
| 4,309,921 | 1/1982 | Miller | 81/3.57 |
| 4,391,167 | 7/1983 | Bergmeister | 81/3.46 |
| 4,537,326 | 8/1985 | Morehead | 220/906 X |
| 4,660,446 | 4/1987 | Soltis | 81/3.55 |
| 4,681,358 | 7/1987 | Smith | 81/3.55 X |
| 4,915,252 | 4/1990 | Schaffer . | |
| 4,979,635 | 12/1990 | Levine | 220/269 |
| 5,110,002 | 5/1992 | Tucker . | |
| 5,203,467 | 4/1993 | Tucker . | |
| 5,351,853 | 10/1994 | Shock . | |
| 5,353,942 | 10/1994 | Dominguez | 220/729 X |
| 5,402,904 | 4/1995 | Close . | |

FOREIGN PATENT DOCUMENTS 2058783 7/1992 Canada .

*Primary Examiner*—Allan N. Shoap
*Assistant Examiner*—Nathan Newhouse
*Attorney, Agent, or Firm*—Richard C. Litman

[57] ABSTRACT

A beverage can opening protector made of a single piece of a flexible, resilient, waterproof material, and having a rounded head portion to cover an opening in a beverage can, a tail portion, and a pair of arms attached to opposite sides of the tail portion and positioned diagonally outward toward the head portion. In the first embodiment, there is a pocket in the head portion, to receive a tab of a beverage can. In the second embodiment, there is a slot in the head portion, through which can pass a tab of a beverage can. In the third embodiment, there are holes in the tail portion, and a peg on the upper surface in the head portion, with the tail portion able to be turned so that it contacts the head portion, and can be retained thereon when the peg passes through one of the holes. In a fourth embodiment, there is a strip having holes, with the strip having a free end, and an opposite end attached to the head portion, and there is a peg that can pass through one of the holes, to releasably attach the free end of the strip. In fifth embodiment, a front portion has a pocket to retain a front side of the tab on a can, and instead of a tail portion there is a rounded rear portion, to cover a rear side of the tab, on which it is retained by two oppositely positioned flanges.

12 Claims, 5 Drawing Sheets

BEVERAGE CAN OPENING PROTECTOR

BACKGROUND OF THE INVENTION

1. Field of the Invention

The present invention relates to a beverage can opening protector that is attached to the tab by which the can is opened.

2. Description of the Prior Art

When a beverage can of the type with a pivoting tab is opened, it is desirable to have a convenient means for covering the opening. The contents of the can may become accidently contaminated by debris or an insect. It is even possible that a stinging insect may enter an opened soda can, presenting a dangerous situation. An ordinary person could receive a sting on the lip or inside the mouth, however, for an allergic person such a sting could result in a life threatening situation. A cover for the opening may also preserve carbonation in sodas and slow down the warming of cold beverages by reducing contact with the ambient atmosphere. While there are previous inventions for covering beverage can openings, it will be seen that none are equivalent to the present invention.

U.S. Pat. No. 4,915,252, issued on Apr. 10, 1990, to Joel L. Schaffer, discloses a beverage can stopper with a groove into which the edge of the beverage can opening may be removably inserted. The instant invention is distinguishable in that it covers the opening but is not inserted into it, and it has a tail portion by which it is retained on a tab on the top of the can.

U.S. Pat. No. 5,110,002, issued on May 5, 1992, to Terence Tucker, and U.S. Pat. No. 5,203,467, issued on Apr. 20, 1993, to Terence Tucker, disclose a protective cap that is snapped over the top of a beverage can and has a hinged cover that may seal the can opening. The instant invention is distinguishable in that it does not cover the entire top of the can, but may be attached to the tab by which contemporary beverage cans are usually opened.

U.S. Pat. No. 5,351,853, issued on Oct. 4, 1994, to John P. Shock, discloses a beverage can holder having a horizontal portion that slides over the can opening and under the tab used to open the can, and a vertical handle integral with the horizontal portion. The instant invention is distinguishable in that it has a tail portion that can fit through a hole in the tab or, alternatively, around the tab.

U.S. Pat. No. 5,353,942, issued on Oct. 11, 1994, to Oscar Dominguez, discloses a device for covering a container opening following removal of the pull tab. The device includes a flat member that covers the opening and is pivotally attached to a wire member that may be attached to the top edge of the can. The instant invention is distinguishable in that it requires no wire member, and it is attached to the tab rather than the top edge of the can.

U.S. Pat. No. 5,402,904, issued on Apr. 4, 1995, to William T. Close, and Canadian Patent No. 2,058,783, issued on Jul. 8, 1992, to William T. Close, disclose a reusable beverage can lid designed to cover the entire top of the can. The lid includes a release lever, and a cammed hinged flip lid that fits over the can opening. The instant invention is distinguishable in that it does not cover the entire top of the can, and it requires no levers or hinges.

U.S. Pat. No. Des. 329,604, issued on Sep. 22, 1992, to Ronald R. Kuczer, discloses a design for a re-closable container cap which has a grated opening and a cover that slides over the opening. The instant invention is distinguishable in that it is not designed to cover the entire top of the container, and it has no grated opening.

None of the above inventions and patents, taken either singly or in combination, is seen to describe the instant invention as claimed.

SUMMARY OF THE INVENTION

The present invention relates to a beverage can opening protector made of a single piece of a flexible, resilient, waterproof material. The opening protector includes a rounded head portion for covering an opening of a beverage can, a tail portion, and a pair of arms attached to opposite sides of the tail portion and positioned diagonally outward toward the head portion. In a first embodiment there is a pocket in the head portion for receiving a tab of a beverage can. In a second embodiment, there is a slot in the head portion through which a tab of a beverage can may pass. In a third embodiment, there is an arrangement of holes in the tail portion and a peg on the upper surface of the head portion, whereby folding of the tail portion so that it contacts the head portion allows the peg to pass through and be retained within one of the holes. In a fourth embodiment, there is an additional strip attached at one end to the head portion, with its free end positioned below the tail portion. The strip includes an arrangement of holes which are disposed to receive and releasably retain a peg positioned on the tail portion adjacent the head portion. In a fifth embodiment, a front portion has a pocket to retain a front side of the tab on a can, and instead of a tail portion there is a rounded rear portion having two oppositely positioned flanges which retain the tab and allow the rear portion to cover a rear side of the tab.

Accordingly, it is a principal object of the invention to provide a means for preventing contamination of the contents of a beverage can.

It is another object of the invention to provide a means for preserving carbonation in a soft drink after the can containing it has been opened.

It is a further object of the invention to slow down the warming of a cold liquid after the can containing it has been opened.

Still another object of the invention is to provide a beverage can opening protector that can be attached to the tabs by which the cans are opened.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a flexible device that can be removably attached to a beverage container, such as a beverage can of the type having a tab that may be pivoted to create an opening in the container. The device is attached to the tab, and covers the opening to prevent the contents of the container from being contaminated. The device may also help to preserve carbonation and the temperature of the contents.

Figure 1:
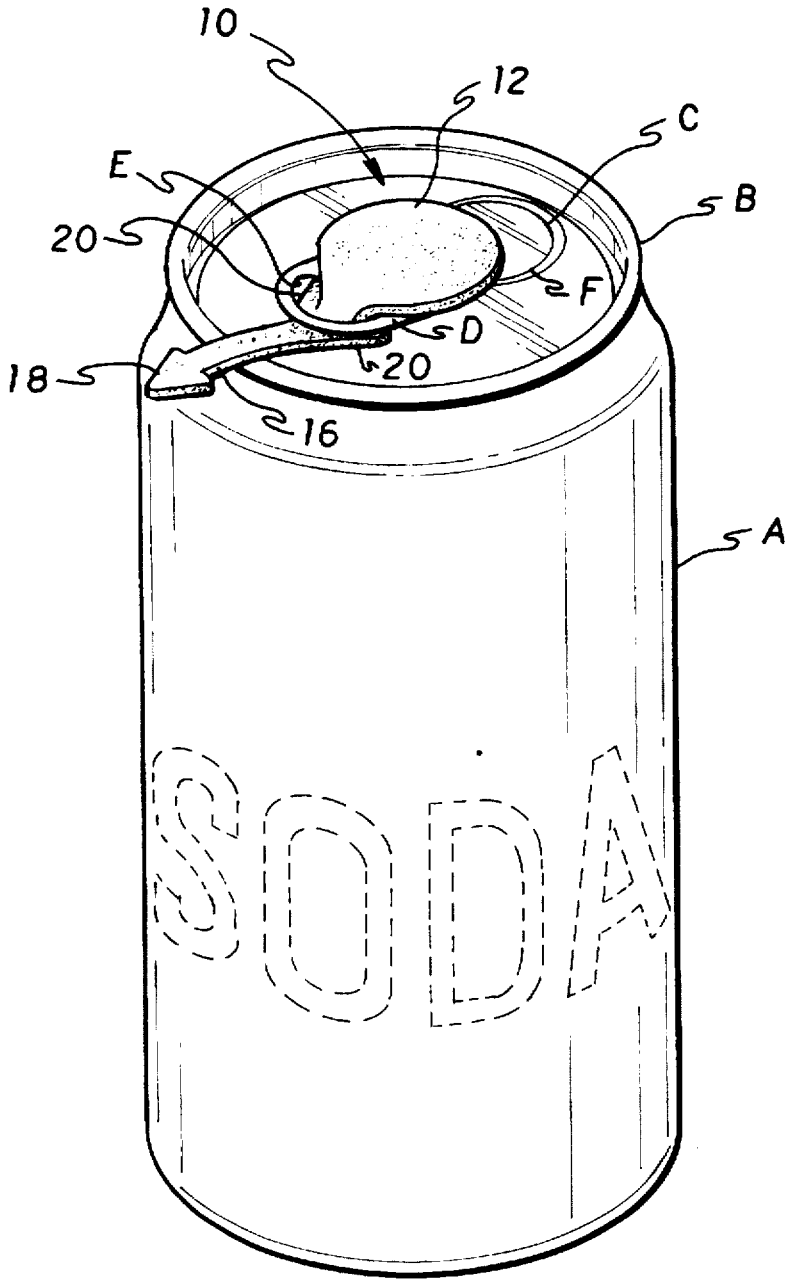
FIG. 1 is an environmental view of the first embodiment of the invention attached to an unopened soda can.

FIG. 1 is an environmental view of the first embodiment of the invention 10 attached to an unopened soda can A. The invention is attached to the can's top surface B, which has an opening C, that is sealed by a metal plate or tang F, to which is attached a tab D having a hole E designed to make it easier to grasp. The can is opened by raising the tab on a side opposite from where it is attached to the tang, and rotating it forward, pushing the tang downward and inside the can, thus breaking the seal. The tab may then be rotated backward, so that it again lies flat on the top surface of the can, where it cannot hinder consumption of the beverage. The invention has a head portion 12 designed to cover the opening of the container. In the first embodiment, it also has a tail portion 16, with a triangular end portion 18, and a pair of diagonal side arms 20. The first embodiment may be attached to the can before opening by slipping the tail portion through the hole in the tab so that the head portion is above the tab, but the side arms are below it.

Figure 2:
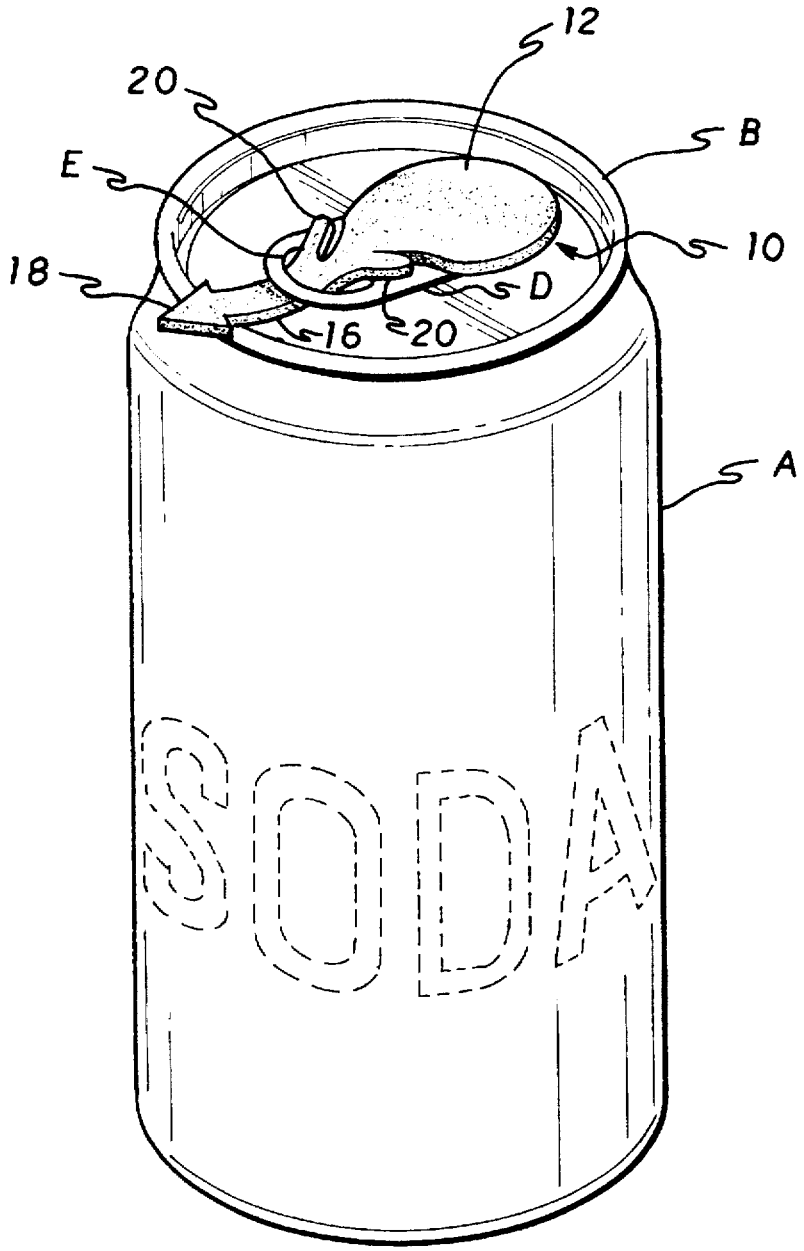
FIG. 2 is an environmental view of the first embodiment of the invention attached to an opened soda can.

FIG. 2 is an environmental view of the first embodiment of the invention attached to an opened soda can, with the main part covering the opening. It can be seen that after the tab has been pushed forward to open the can, and then back again, the side arms may be above the tab. Pushing down on the tail portion, by pushing down on the tab, should cause the head portion to rise, uncovering the opening when the user desires to drinks from the can. The user may reseal the opening by pushing down on the head portion with his or her upper lip. It may be necessary to pull on the tail to adjust the position of the invention on the can.

Figure 3:
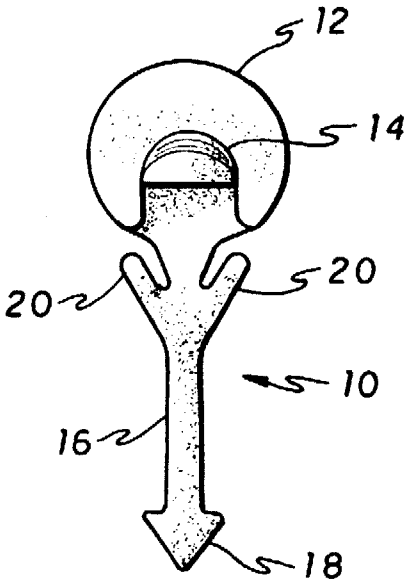
FIG. 3 is a bottom plan view of the first embodiment of the invention.
Figure 4:
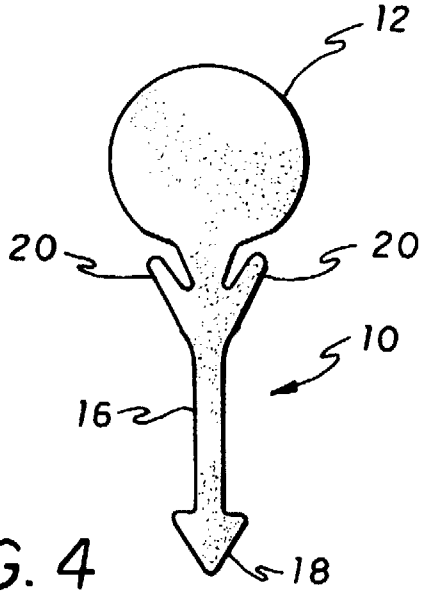
FIG. 4 is a top plan view of the first embodiment of the invention.

FIG. 3 is a bottom plan view of the first embodiment of the invention, showing the pocket 14 within which the front part of the tab may be retained. FIG. 4 is a top plan view of the first embodiment of the invention.

Figure 5:
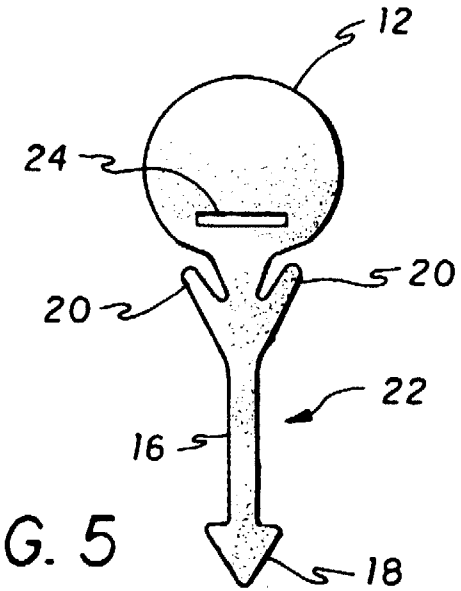
FIG. 5 is a top plan view of the second embodiment of the invention.

FIG. 5 is a top plan view of the second embodiment of the invention 22, which has a slot 24 in the main part 12, through which the front part of the tab can be inserted. The bottom surface of the second embodiment is identical to the top surface. There is no pocket, as in the first embodiment. Otherwise, the second embodiment is identical to the first embodiment.

Figure 6:
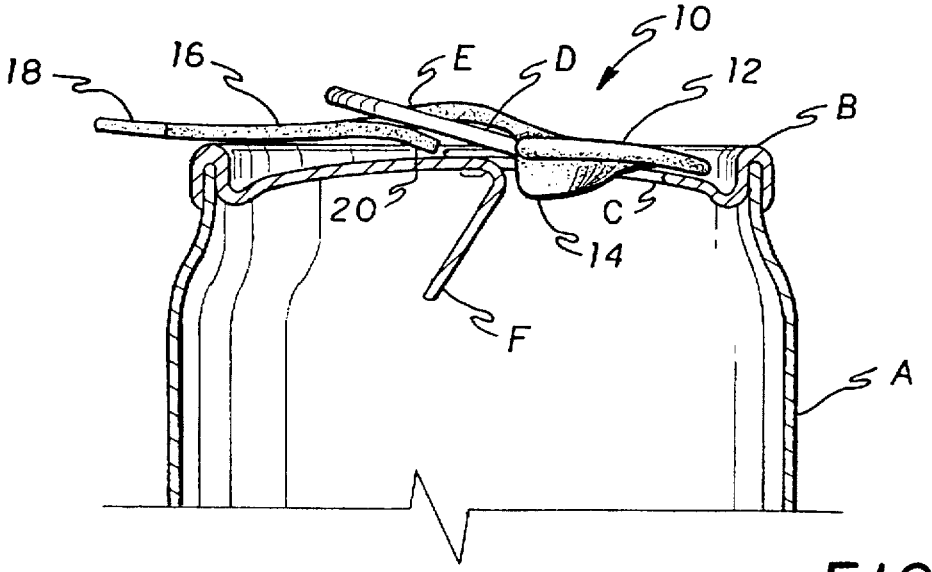
FIG. 6 is a right side elevational view of the first embodiment of the invention, attached to an opened soda can shown in cross-section.

FIG. 6 is a right side elevational view of the first embodiment of the invention 10, attached to the top side B of an opened soda can A shown in cross-section. It can be seen how the head portion 12 covers the opening C, while the tab D is retained in the pocket 14. The tail portion 16, with end portion 18, passes through the hole E in the tab. The tang F has been pushed down inside the can when it was opened. In this instance, the side arms 20 are still below the tab after it has been opened.

Figure 7:
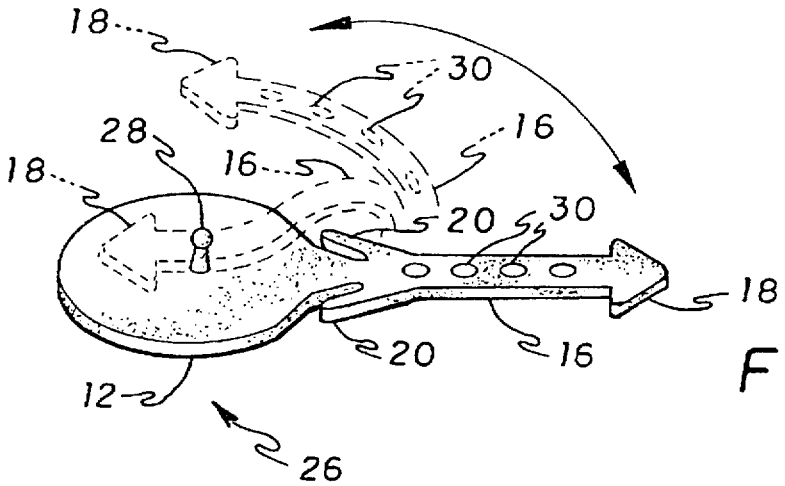
FIG. 7 is a perspective view of the third embodiment of the invention.

FIG. 7 is a perspective view of the third embodiment of the invention 26, having a peg 28 in the middle of the head portion 12 and a plurality of holes 30 in the tail portion 16. The tail portion is shown in a flat position in solid lines and in curved or folded positions in broken lines. The tail portion may be inserted through the hole in the tab, as before, and then folded forward around the tab where it may be releasably secured against the head portion by forcing the peg through one of its holes. The plurality of holes allows the invention to fit different sizes of cans and tabs.

Figure 8:
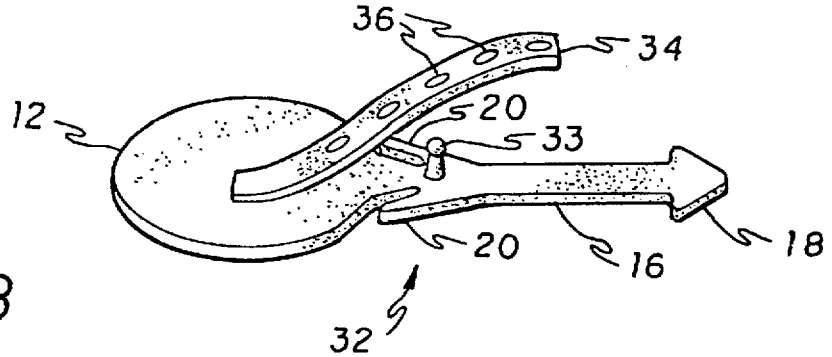
FIG. 8 is a perspective view of the fourth embodiment of the invention.

FIG. 8 is a perspective view of the fourth embodiment of the invention 32, having a peg 33 in the vicinity of the joinder between the head portion 12 and the tail portion 16, and a separate strip 34, with a plurality of holes 36, attached at one end to the head portion. The fourth embodiment is placed on the can so that the peg passes through the hole of the tab, and the separate strip is then attached to the peg using one of its holes, thereby securing the invention to the tab and can.

Figure 9:
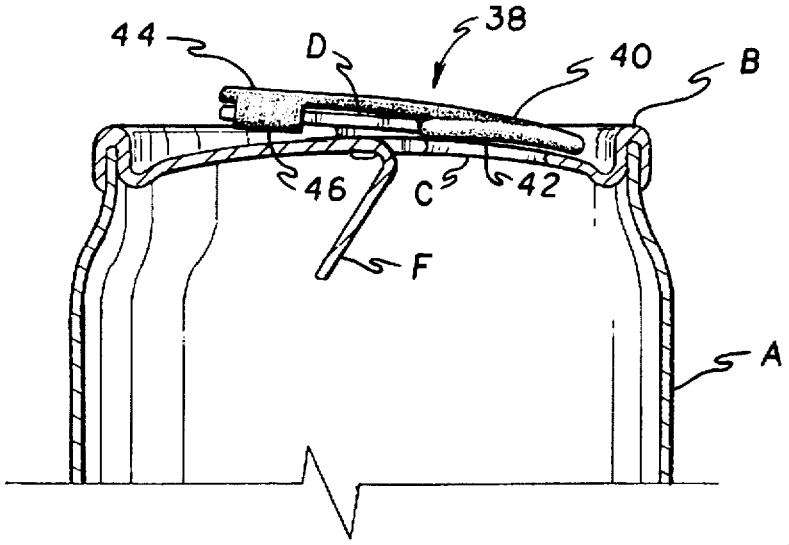
FIG. 9 is a right side elevational view of the fifth embodiment of the invention, attached to an opened soda can shown in cross-section.
Figure 10:
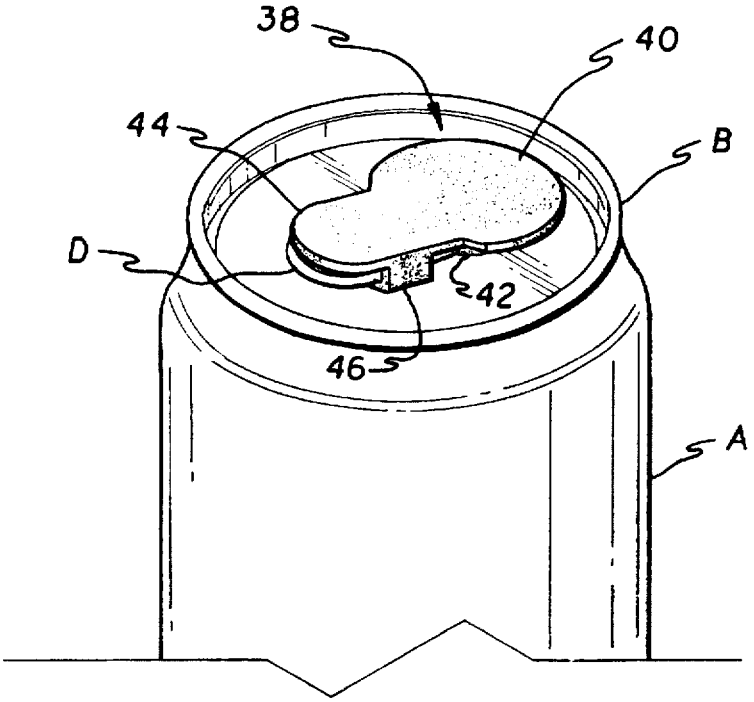
FIG. 10 is an environmental view of the fifth embodiment of the invention attached to an opened soda can.

FIG. 9 is a right side elevational view of the fifth embodiment of the invention 38 which has been attached to the top surface B of an opened soda can A (shown in cross-section). The tang F has been pushed back using the tab D to provide opening C. The tab is different from the tabs shown previously in that it does not have a hole through which a tail portion of the invention may be inserted. The opening is covered by the front portion 40, and the tab is retained in the pocket 42. The rounded rear portion 44 of the fifth embodiment has a pair of flanges 46 (only one is shown) on opposite sides of the rear portion 44. The flanges 46 are disposed to receive and releasably retain the rear portion of the tab. FIG. 10 is an environmental view of the fifth embodiment of the invention attached to an opened soda can.

The invention is made of a flexible plastic or other flexible waterproof material. Preferably the invention is made by injection molding from a thermoplastic material having a texture, flexibility, and water and air imperviousness similar to natural rubber. Microfine wood particles or like matter may be dispersed in the plastic to increase its strength.

It is to be understood that the present invention is not limited to the embodiments described above, but encompasses any and all embodiments within the scope of the following claims.

I claim:

1. A beverage can opening protector for a beverage can having a pull tab, comprising:

a single piece of material having an upper surface and a lower surface, wherein said piece of material is flexible, resilient and waterproof, said piece of material also having:

a head portion, suitably dimensioned and configured to cover an opening of a beverage can;

a tail portion that is narrower than the head portion and has a front end attached to the head portion, two lateral opposing sides and an opposite rear end; and a pair of arms, each arm attached to one said opposing side of the tail portion for attaching the protector to the pull tab.

2. The beverage can opening protector according to claim 1, wherein the arms are positioned diagonally outward toward the head portion.

3. The beverage can opening protector according to claim 2, wherein the head portion is rounded.

4. The beverage can opening protector according to claim 3, wherein the tail portion has parallel sides, and the rear end of the tail portion is triangular.

5. The beverage can opening protector according to claim 4, wherein within the lower surface of the head portion is a pocket, suitably dimensioned and configured to receive a tab of a beverage can.

6. The beverage can opening protector according to claim 4, wherein there is a slot in the head portion, passing between the upper surface and the lower surface, suitably dimensioned and configured to allow a tab of a beverage can to pass through the slot.

7. The beverage can opening protector according to claim 4, wherein there is at least one hole in the tail portion, and a peg on the upper surface in the head portion, with the tail portion having the capacity to be turned so that the upper surface in the tail portion contacts the upper surface in the head portion, and can be retained thereon when the peg passes through said hole.

8. The beverage can opening protector according to claim 7, wherein there are a plurality of holes in the tail portion.

9. The beverage can opening protector according to claim 4, wherein there is a strip having at least one hole, with the strip having a free end, and an opposite end attached to the upper surface in the head portion, and there is a peg on the upper surface, that can pass through said hole, to releasably attach the free end of the strip to the upper surface.

10. The beverage can opening protector according to claim 9, wherein there are a plurality of holes in the strip.

11. A beverage can opening protector for a beverage can having a pull tab, said pull tab having a front side adjacent an opening and a rear side opposite the front side, said protector comprising:

a single piece of material having an upper surface and a lower surface, wherein said piece of material is flexible, resilient and waterproof, said piece of material having:

a front portion, suitably dimensioned and configured to cover the opening in the beverage can;

a pocket in the lower surface of the front portion, suitably dimensioned and configured to receive the front side of the tab on the beverage can; and a rear portion, suitably dimensioned and configured to cover the rear side of the tab on the beverage can.

12. A beverage can opening protector according to claim 11, including a pair of oppositely positioned flanges on the lower surface of the rear portion, suitably dimensioned and configured to retain the rear side of the tab on a beverage can.

* * * * *